US007293503B2

(12) United States Patent
Ruoff et al.

(10) Patent No.: US 7,293,503 B2
(45) Date of Patent: Nov. 13, 2007

(54) SLIDE-IN PRINT UNIT FOR A VARIABLE FORMAT IN OFFSET PRINTING

(75) Inventors: Wolfgang Ruoff, Lörrach (DE); Stefan Beyersdorff, Steinen (DE)

(73) Assignee: Müller Martini Holding AG, Hergiswil (CH)

( * ) Notice: Subject to any disclaimer, the term of this patent is extended or adjusted under 35 U.S.C. 154(b) by 68 days.

(21) Appl. No.: 11/067,220

(22) Filed: Feb. 28, 2005

(65) Prior Publication Data

US 2005/0188865 A1 Sep. 1, 2005

(30) Foreign Application Priority Data

Feb. 27, 2004 (EP) ..... 04405112

(51) Int. Cl.
*B41F 13/20* (2006.01)
*B41F 13/44* (2006.01)

(52) U.S. Cl. ..... 101/216; 101/247; 101/479

(58) Field of Classification Search ..... 101/216, 101/217, 247, 375, 376, 479
See application file for complete search history.

(56) References Cited

U.S. PATENT DOCUMENTS 1,934,776 A 11/1933 Stoessel
3,606,835 A 9/1971 Chambon
3,616,751 A 11/1971 Mowry
6,776,093 B2 * 8/2004 Masuch ..... 101/216
2001/0017087 A1 * 8/2001 Schneider et al. ..... 101/216
2005/0160928 A1 * 7/2005 Motard et al. ..... 101/217

FOREIGN PATENT DOCUMENTS

DE 199 55 084 A1 5/2001
EP 0 644 048 A2 3/1995
EP 1 101 611 A1 5/2001

* cited by examiner

*Primary Examiner*—Leslie J. Evanisko
(74) *Attorney, Agent, or Firm*—Venable LLP; Robert Kinberg; Steven J. Schwarz

(57) ABSTRACT

A slide-in print unit for a variable format in offset printing includes a machine frame. A counter pressure cylinder, rubber blanket cylinder, and plate cylinder are positioned within the machine frame. A drive mechanism for the cylinders includes a joint drive for the rubber blanket cylinder and the plate cylinder.

10 Claims, 3 Drawing Sheets

SLIDE-IN PRINT UNIT FOR A VARIABLE FORMAT IN OFFSET PRINTING

CROSS-REFERENCE TO RELATED APPLICATION

This application claims the priority of European Patent Application No. 04405112.6-1251, filed on Feb. 27, 2004, the disclosure of which is incorporated herein by reference.

BACKGROUND OF THE INVENTION

The invention relates to a slide-in print unit for a variable format in offset printing, the unit comprising a machine frame within which there is positioned a counter pressure cylinder, rubber blanket cylinder, and plate cylinder, as well as a drive mechanism for the aforementioned cylinders.

Slide-in print units of this type are known and are disclosed, for example, in European patent document EP 1 101 611 A and German patent document DE 199 55 084A. These slide-in units respectively comprise a counter pressure cylinder, a rubber blanket cylinder and a plate cylinder. An endless paper web moves between the rubber blanket cylinder and the counter pressure cylinder. An inking unit installed in the print unit applies ink to the plate cylinder which in turn transfers ink to the rubber blanket cylinder. Changing the print image length with such a slide-in print unit requires the replacement of format sections of the plate cylinder and the rubber blanket cylinder. These format sections have a sleeve-type design and are respectively fitted in an axial direction onto a so-called air shaft. Following the replacement of the format sections, the axial spacing between the cylinders and, as a rule, also between the cylinders and the inking unit must be changed. In addition, the speed of the rubber blanket cylinder and the plate cylinder must be adapted.

The following two embodiments are known from practical operations as drive means for a slide-in print unit of this type.

For one embodiment, the counter pressure cylinder, the rubber blanket cylinder, the plate cylinder, and the inking unit are each provided with a separate drive, for example a separate motor. On the whole, a slide-in print unit of this type therefore has four independent drives. With this print unit, the rubber blanket cylinder and the plate cylinder speeds can be adapted without problems if the print image length changes. However, the costs of producing such a print unit are comparably high because suitable motors are expensive.

With the second embodiment, one drive is provided for driving the complete slide-in print unit, including the format sections and the inking unit. The aforementioned cylinders and the inking unit are thus driven jointly by a single drive. If the print image length is changed, then drive wheels mounted on the aforementioned air shafts must be replaced, so that the circumferences of the partial circles for the drive wheels correspond once more to the print image length. The costs for producing a print unit of this type are comparably low. The disadvantage lies in the long set-up time during a format change because the drive wheels must be replaced, as previously mentioned.

SUMMARY OF THE INVENTION

It is an object of the present invention to create a slide-in print unit of the aforementioned type which can be produced at a lower cost while having a short set-up time.

The above and other objects are accomplished according to the invention by the provision of a slide-in print unit for a variable format in offset printing, comprising: a machine frame; a counter pressure cylinder, rubber blanket cylinder, and plate cylinder positioned within the machine frame; and drive means for the cylinders, including a joint drive for the rubber blanket cylinder and the plate cylinder.

Thus, for a slide-in print unit as first defined above, the object of the invention is solved by using a separate drive for jointly driving the rubber blanket cylinder and the plate cylinder. The counter pressure cylinder and the inking unit are operated separately from the rubber blanket cylinder and the plate cylinder by means of a motor or gear. The drive means can therefore be produced at a much lower cost than required for the above-mentioned embodiment which calls for each cylinder and the inking unit to be provided with a separate drive. At the low since no drive wheels must be replaced to change the print image length.

According to one modification of the invention, the plate cylinder and the rubber blanket cylinder are driven by means of a coupling gear. All drive wheels remain engaged during a change in the spacing between rubber blanket cylinder and plate cylinder, thereby making it particularly easy to effect a change in the print image length.

An especially simple and functionally secure embodiment is obtained if, according to a further modification of the invention, the coupling gear is a gear with two intermediate members, wherein one of the two intermediate members is driven, wherein a motor that is operatively connected to one of the intermediate members is used for the drive. This motor preferably has a fixed motor shaft. The coupling gear preferably is a toothed gearing with four gearwheels, wherein two of these gearwheels are respectively attached to one of the two driven cylinders.

Further advantageous features will become apparent from following detailed description considered in conjunction with the accompanying drawings.

DETAILED DESCRIPTION OF THE INVENTION

Figure 1:
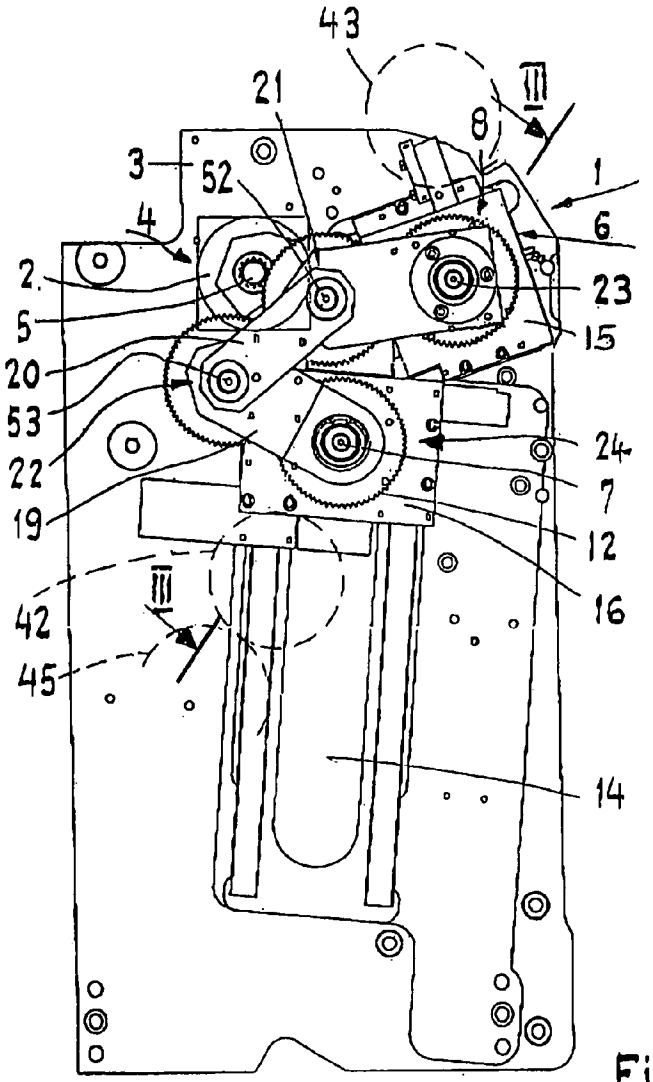
FIG. 1 shows a view of a slide-in print unit according to the invention, adjusted to a format of 20."

Referring to FIG. 1, there is shown a view from the side of a slide-in print unit 1, comprising a plate cylinder 23 and a rubber blanket cylinder 24 which are respectively positioned on two bearing plates 3 and 25 (see FIGS. 3 and 4) of an additional machine frame which is not shown in further detail herein. The plate cylinder 23 and the rubber blanket cylinder 24 are driven by a joint drive 4. A counter pressure cylinder 42 is also positioned in the slide-in print unit 1, but is indicated herein only with dashed lines. This counter pressure cylinder 42 is provided with a support shaft 44 and is driven by a different drive unit 45 both of which are indicated only with dashed lines. Furthermore indicated with dashed lines only is an inking unit 43 which can have a standard design and is used for applying ink to the plate cylinder 23. An endless paper web 41 moves between the rubber blanket cylinder 24 and the counter pressure cylinder 42.

Figure 2:
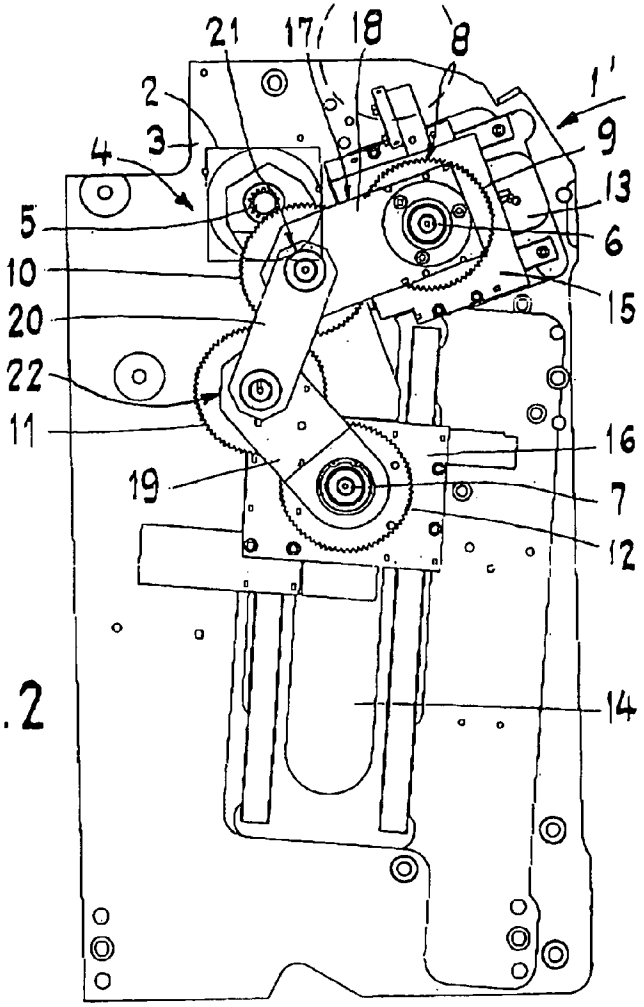
FIG. 2 shows a view according to FIG. 1 of a slide-in print unit that is adjusted to a format of 28."
Figure 3:
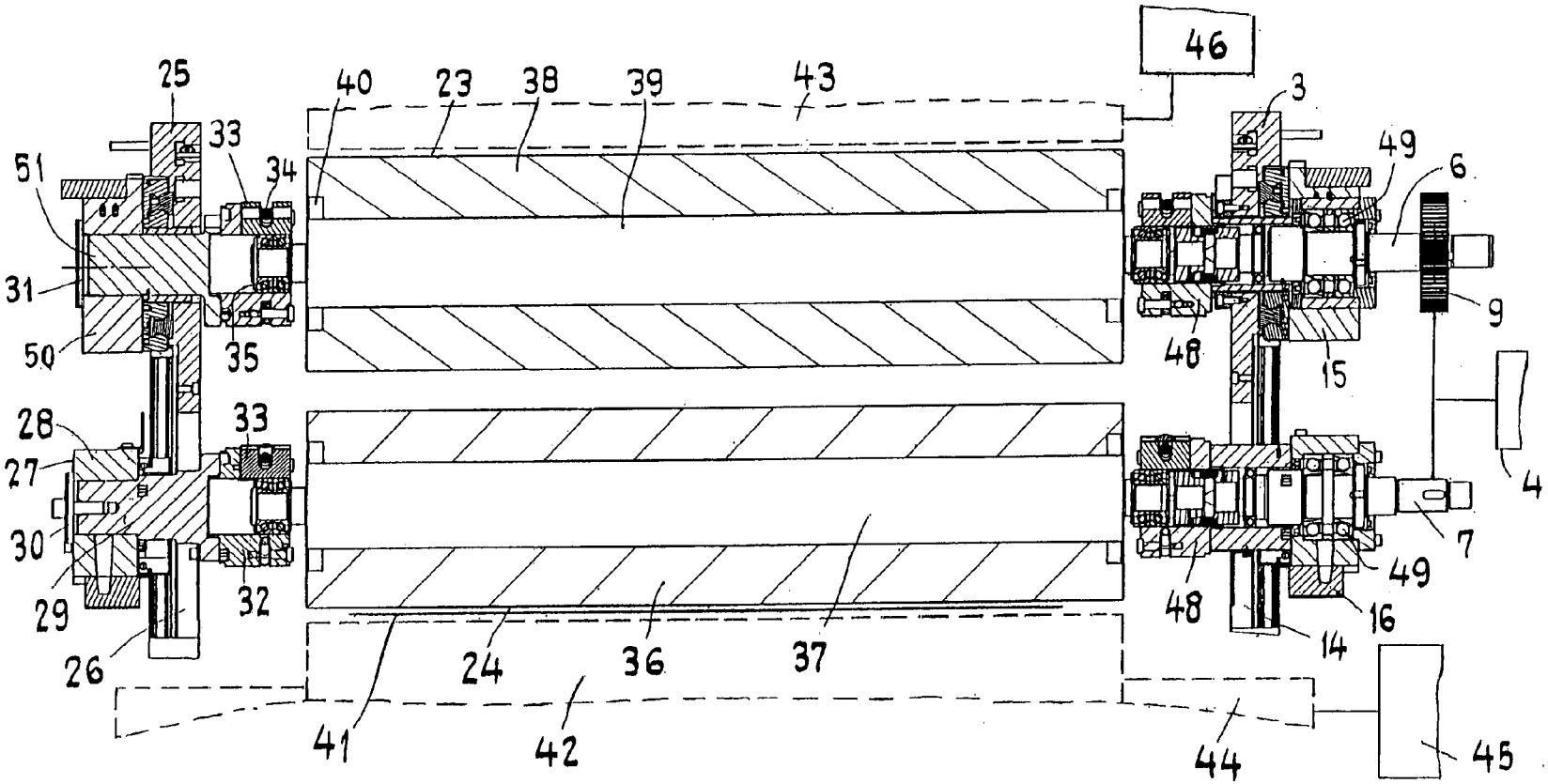
FIG. 3 is a section along line III-III in FIG. 1.

FIG. 3 shows that the plate cylinder 23 is provided with a support shaft 39 and a format section 38. The rubber blanket cylinder 24 has a similar design and is provided with a support shaft 37 and a format section 36. To change the print image length, the plate cylinders 23 and the rubber blanket cylinder 24 are replaced. The spacing between the rotational axes for the plate cylinder 23 and the rubber blanket cylinder 24 changes as a result of this replacement. To adapt to this spacing, at least the rubber blanket cylinder 24 is positioned displaceable inside guide slots 14 and 26, in the two bearing plates 3 and 25, respectively. The plate cylinder 23 in this case is also positioned displaceable inside guide slots 13 (see FIG. 4). However, this is not a requirement. FIG. 1 shows the print unit 1, adjusted to a 20" format. The slide-in print unit 1 shown in FIG. 2 is adjusted to a 28" format. For the changeover from one format to another one, the plate cylinder 23 and the rubber blanket cylinder 24 are replaced and the speeds of both cylinders are adapted. Also conceivable is a design where the format sections 36 and 38 take the form of sleeves fitted onto air shafts. During a format change, only the sleeve-shaped format sections are replaced. For the present exemplary embodiment, the support shafts 37 and/or 39 for the plate cylinder 23 and the rubber blanket cylinder 24, however, form a single unit together with the format section 36 and/or 38.

Referring to FIG. 3, the support shafts 37 and 39 are provided on their respective ends with a roller bearing 35 which is secured between a lower bearing shell 32 and an upper bearing shell 33. The upper bearing shell 33 can be tilted away, so that the plate cylinder 23 and the rubber blanket cylinder 24 respectively can be inserted from above into the respective lower bearing shells 32. According to FIG. 3, the support shaft 39 of the plate cylinder 23 is connected on the right end via a coupling mechanism 48 to a drive shaft 6 for the torque transfer. The support shaft 37 for the rubber blanket cylinder 24 is also connected via a coupling mechanism 48 to a drive shaft 7. The coupling mechanisms 48 and the drive shafts 6 and 7 are respectively positioned with a roller bearing 49 in a plate 15 and/or 16, wherein these plates 15 and 16 are respectively arranged on the outside of the bearing plate 3.

With the aid of a plate 28 and/or 50 and a bearing journal 29 and/or 51 and a bearing 27, the plate cylinder 23 and the rubber blanket cylinder 24 are positioned so as to be displaceable on the bearing plate 25. The bearing journals 29 and 51 project through the guide slot 26, respectively, wherein clamping plates 30 and 31, respectively, connect the bearing journals 29 and 51 to the plates 28 and 50, respectively.

As mentioned before, the drive 4 is provided only for the plate cylinder 23 and the rubber blanket cylinder 24. As a result, a separate drive jointly drives these two cylinders. The counter pressure cylinder 42 and the inking unit 43 are provided with separate drives 45 and/or 46, wherein the use of a joint drive for the counter pressure cylinder 42 and the inking unit 43 is also conceivable.

The drive 4 comprises a motor that is provided with a pinion 5 and meshes with a first intermediate gearwheel 10. The motor 2 is rigidly connected to the bearing plate 3. The speed of motor 2 can be adapted. The motor 2 remains in the same position for the changeover to a different print image length, but its speed is adapted to the new print image length.

Figure 4:
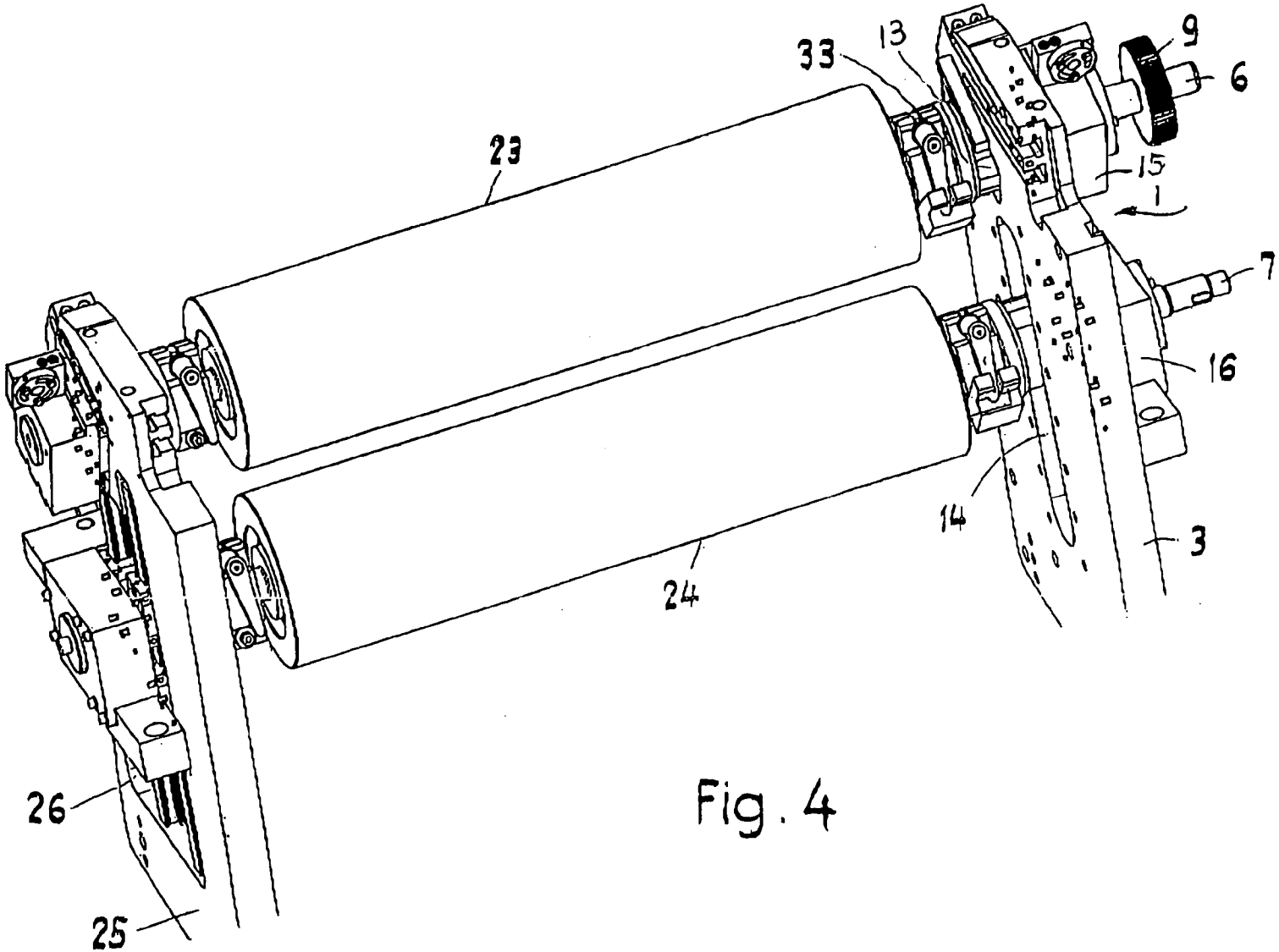
FIG. 4 is a three-dimensional partial view of the slide-in print unit according to the invention.

The first intermediate gearwheel 10 meshes with a second intermediate gearwheel 11 as well as with a toothed gearwheel 9 which is mounted on the drive shaft 6, as best shown in FIG. 4. The second intermediate gearwheel 11 meshes with a toothed gearwheel 12 which is connected to the drive shaft 7, such that it rotates along. This toothed gearwheel 12 is omitted in FIG. 4 for drawing reasons. The four toothed gearwheels 9, 10, 11 and 12 form a gearing 8 that is driven by the motor 2. The pinion 5 remains engaged in the toothed gearwheel 10 and the toothed gearwheels 9, 10, 11 and 12 remain engaged with each other, even if the print image length changes.

The drive 4 is provided with a set of coupling rods 17, comprising a first lever 18, a second lever 19, as well as an intermediate lever 20. The intermediate lever 20 is connected via a first rotating joint 21 to the first lever 18 and via a rotating joint 22 to the second lever 19. These rotating joints 21 and 22 are formed by axles 52 and 53 that are connected to the first intermediate wheel 10 and/or the second intermediate wheel 11. The set of coupling rods 17 ensures that the two intermediate gearwheels 10 and 11 continue to mesh and that these wheels also remain engaged with the toothed gearwheels 9 and 12. This engagement is maintained even for the aforementioned change in print image length. If the print image length is changed from 20" to 28" as shown in FIGS. 1 and 2, then the spacing between the drive shafts 6 and 7 increases. In the process, the plate cylinder 23 is displaced in the guide slot 26 and the rubber blanket cylinder 24 is displaced in the guide slot 14. With a change of this type, the counter pressure cylinder 42 is also displaced. Furthermore conceivable is an embodiment where the inking unit 43 is adapted instead of the plate cylinder 23, wherein respective inking units are known to the person skilled in the art. The diameters and circumferences of the plate cylinder 23 and the rubber blanket cylinder 24 are larger for the slide-in print unit 1' than for the slide-in print unit 1. The counter pressure cylinder 42, on the other hand, is the same for both slide-in print units 1 and 1' and need not be replaced.

To replace the plate cylinder 23 and the rubber blanket cylinder 24, the upper bearing shells 32 are released, so that the plate cylinder 23 and the rubber blanket cylinder 24 can be lifted out of the respective lower bearing shells 32. To facilitate this operation, the two cylinders 23 and 24 are each provided with recessed grips 40. The new cylinders are then inserted into the lower bearing shells 32 and 33. The two cylinders 23 and 24 are then connected to the drive shaft 6 and/or 7 for the torque transfer by axially displacing them. The roller bearings 35 are secured in axial direction by tightening the tensioning screws 34. Finally, the axial distances and the speeds are adapted. To adapt the speed of plate cylinder 23 and rubber blanket cylinder 24, it is only necessary to adjust the speed of the motor 2. However, it is not necessary to replace the drive wheels or the like.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A slide-in print unit for a variable format in offset printing, comprising:

a machine frame;

a counter pressure cylinder, rubber blanket cylinder, and plate cylinder positioned within the machine frame;

drive means for the cylinders, including a joint drive for the rubber blanket cylinder and the plate cylinder; and a rod assembly by which the plate cylinder and the rubber blanket cylinder are articulatably connected to one another, wherein the rod assembly comprises a first lever connected to the plate cylinder, a second lever connected to the rubber blanket cylinder, and a third lever which connects the first and second levers to each other.

2. The slide-in print unit according to claim 1, wherein the joint drive comprises a coupling gear.

3. The slide-in print unit according to claim 1, wherein the joint drive comprises a gear with two intermediate members, wherein one of the intermediate members is driven.

4. The slide-in print unit according to claim 2, further including a drive shaft for the rubber blanket cylinder and a drive shaft for the plate cylinder; and wherein the coupling gear includes at least two toothed gearwheels, one of which is mounted on the drive shaft for the rubber blanket cylinder and the other toothed gearwheel is mounted on the drive shaft for the plate cylinder.

5. The slide-in print unit according to claim 3, further including a motor with a drive pinion, wherein the two intermediate members are first and second intermediate toothed gearwheels, one of which meshes with the drive pinion.

6. The slide-in print unit according to claim 5, wherein the third lever is connected at an axis of the first intermediate toothed gearwheel and at an axis of the second intermediate toothed gearwheel.

7. The slide-in print unit according to claim 1, wherein the plate cylinder and the rubber blanket cylinder each have roller bearings and the plate cylinder and the rubber blanket cylinder and their respective roller bearings jointly form a single unit.

8. The slide-in print unit according to claim 7, further including bearing shells in which the plate cylinder and the rubber blanket cylinder are respectively positioned such that they can be lifted out.

9. The slide-in print unit according claim 1, further including a support shaft for the plate cylinder and a support shaft for the rubber blanket cylinder; and roller bearings respectively on each end of each support shaft.

10. A slide-in print unit for a variable format in offset printing, comprising:

a machine frame;

a counter pressure cylinder mounted to the machine frame;

a rubber blanket cylinder mounted to the machine frame, the rubber blanket cylinder including a drive shaft;

a plate cylinder mounted to the machine frame, the plate cylinder including a drive shaft;

drive means for the cylinders, including a separate joint drive that drives the rubber blanket cylinder and the plate cylinder independently from the counter pressure cylinder, wherein the separate joint drive comprises a coupling gear including:

a first toothed gearwheel mounted on the drive shaft for the plate cylinder;

a second toothed gearwheel mounted on the drive shaft for the rubber blanket cylinder;

a first intermediate toothed gearwheel that meshes with the first toothed gearwheel; and a second intermediate toothed gearwheel that meshes with the first intermediate toothed gearwheel and with the second toothed gearwheel; and a motor including a drive pinion that meshes with the first or second intermediate toothed gearwheel.

* * * * *